United States Patent [19]

Hartman, Jr. et al.

[11] 4,319,282

[45] Mar. 9, 1982

[54] FACSIMILE METHOD AND APPARATUS WITH SHEET FEEDING

[75] Inventors: G. William Hartman, Jr., Longwood; Ronald F. Schley, Ocoee, both of Fla.

[73] Assignee: Exxon Research & Engineering Co., Florham Park, N.J.

[21] Appl. No.: 120,489

[22] Filed: Feb. 11, 1980

[51] Int. Cl.[3] ..... H06N 1/08

[52] U.S. Cl. ..... 358/286; 358/285; 358/289; 358/291

[58] Field of Search ..... 358/285, 286, 293, 294, 358/289, 291

[56] References Cited

U.S. PATENT DOCUMENTS

| | | | |
|---|---|---|---|
| 3,064,077 | 11/1962 | Cary | 358/286 |
| 3,469,027 | 9/1969 | Reese | 358/286 |
| 3,610,824 | 10/1971 | Hansen | 358/286 |
| 3,818,126 | 6/1974 | Fomenko | 358/286 |
| 3,845,239 | 10/1974 | Granzow | 358/286 |
| 4,080,634 | 3/1978 | Schreiber | 358/286 |
| 4,087,838 | 5/1978 | Masaki | 358/286 |
| 4,148,076 | 4/1979 | Costello | 358/285 |
| 4,149,196 | 4/1979 | Wada | 358/293 |

FOREIGN PATENT DOCUMENTS

| | | |
|---|---|---|
| 1275950 | 10/1971 | United Kingdom . |
| 1250745 | 6/1972 | United Kingdom . |

*Primary Examiner*—Howard Britton

*Attorney, Agent, or Firm*—Norman L. Norris; Dale M. Heist

[57] ABSTRACT

Document and copy media in a facsimile transceiver are fed along separate paths to a common loading area adjacent a scanning drum. A feed path for hand-fed sheets is located between the document and copy media storage areas to also supply sheets to the common loading area.

13 Claims, 5 Drawing Figures

FACSIMILE METHOD AND APPARATUS WITH SHEET FEEDING

BACKGROUND OF THE INVENTION

This invention relates to facsimile transceivers capable of transmitting information-bearing signals representing the dark-light variations on a document located at the transceiver and converting information-bearing signals to marks or images on a copy medium located at the transceiver so as to form a copy which is a responsible facsimile of a remotely located document.

Most facsimile transceivers in commercial use at the present time are supplied with document or copy medium sheets by hand. In other words, an operator takes an individual sheet of paper, whether a document or a blank piece of copy medium, and places that sheet on or in the scanning means of the transceiver, typically a drum having a clamp for clamping one edge of the sheet.

In facsimile transceivers which are not supplied with document or copy medium sheets by hand but rather are unattended at least to some degree, a variety of techniques are utilitized to feed the documents and copy media to the scanning means. One such technique involves the use of a roll of copy media which is supplied to the scanning means for purposes of receiving facsimile signals and recording those received facsimile signals on the copy media. In the Xerox 410 facsimile transceiver, the document and copy media sheets are supplied from a common storage area. When the transceiver is to operate in a receiving mode, copy medium sheets are loaded into the storage area. When the transceiver is to operate in a transmitting mode, the copy medium must be removed and documents are loaded into the same storage area.

In general, it is considered preferable to provide unattended sheet feeding or copy medium rather then roll feeding so as to eliminate the necessity of cutting the roll at the appropriate place to achieve the desired sheet. Sheet feeding from a stack is also desirable to avoid curling of the copy medium. However, the sheet feeding from a stack requires a more elaborate mechanism to assure reliability.

Where common sheet storage areas are utilized for both documents and copy medium, it is not possible for a transceiver to operate in a completely unattended mode since it is necessary for the operator to remove sheets of one type and substitute sheets of another type when changing from one mode to another, i.e., a transmitting mode to a receiving mode. This is undesirable where a completely unattended mode of operation is required.

SUMMARY OF THE INVENTION

It is an object of this invention to provide a facsimile method and apparatus which provides for storing a plurality of document sheets and a plurality of copy medium sheets simultaneously and at different locations so as to permit an unattended mode of operation.

Another object of this invention is to provide the foregoing in a minimum of space.

A further object of this invention to provide the foregoing and still permit hand feeding of single sheets.

In accordance with these and other objects, a preferred embodiment of the invention comprises a facsimile transmitting and receiving apparatus including scanning means, document storage means, copy medium storage means, a document feed path from the document storage means, and a copy medium feed path from the copy medium storage means.

In accordance with one important aspect of the invention, the document feed path and the copy medium feed path merge so as to form a single feed path at the scanning means.

In accordance with another important aspect of the invention, an additional sheet feed path is provided which merges with the document feed path and the copy medium feed path at the single sheet feed path. Preferably, the additional sheet feed path is located between the document storage means and the copy medium storage means.

In accordance with another important aspect of the invention, a removable cassette may be utilized to store documents in the document storage means. Similarly, a removable cassette may be utilized for holding documents in the copy medium storage means.

In any particularly preferred embodiment of the invention, the sheets of document in the document storage means are disposed substantially parallel with the sheets of copy medium in the copy medium storage means. The cassettes are arranged back-to-back with one cassette being inverted with respect to the other cassette.

DETAILED DESCRIPTION OF A PREFERRED EMBODIMENT

Figure 1:
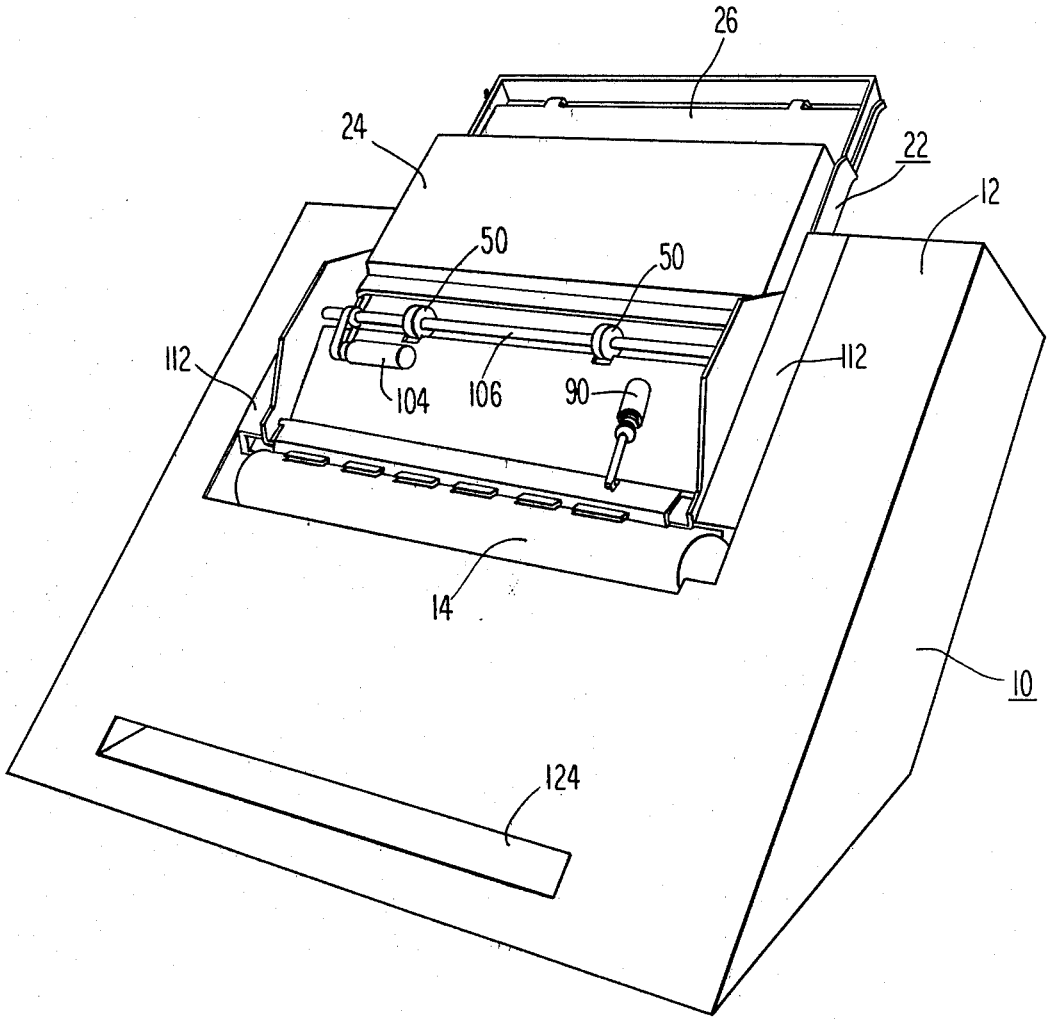
FIG. 1 is the perspective view of a facsimile transceiver which embodies the invention.
Figure 2:
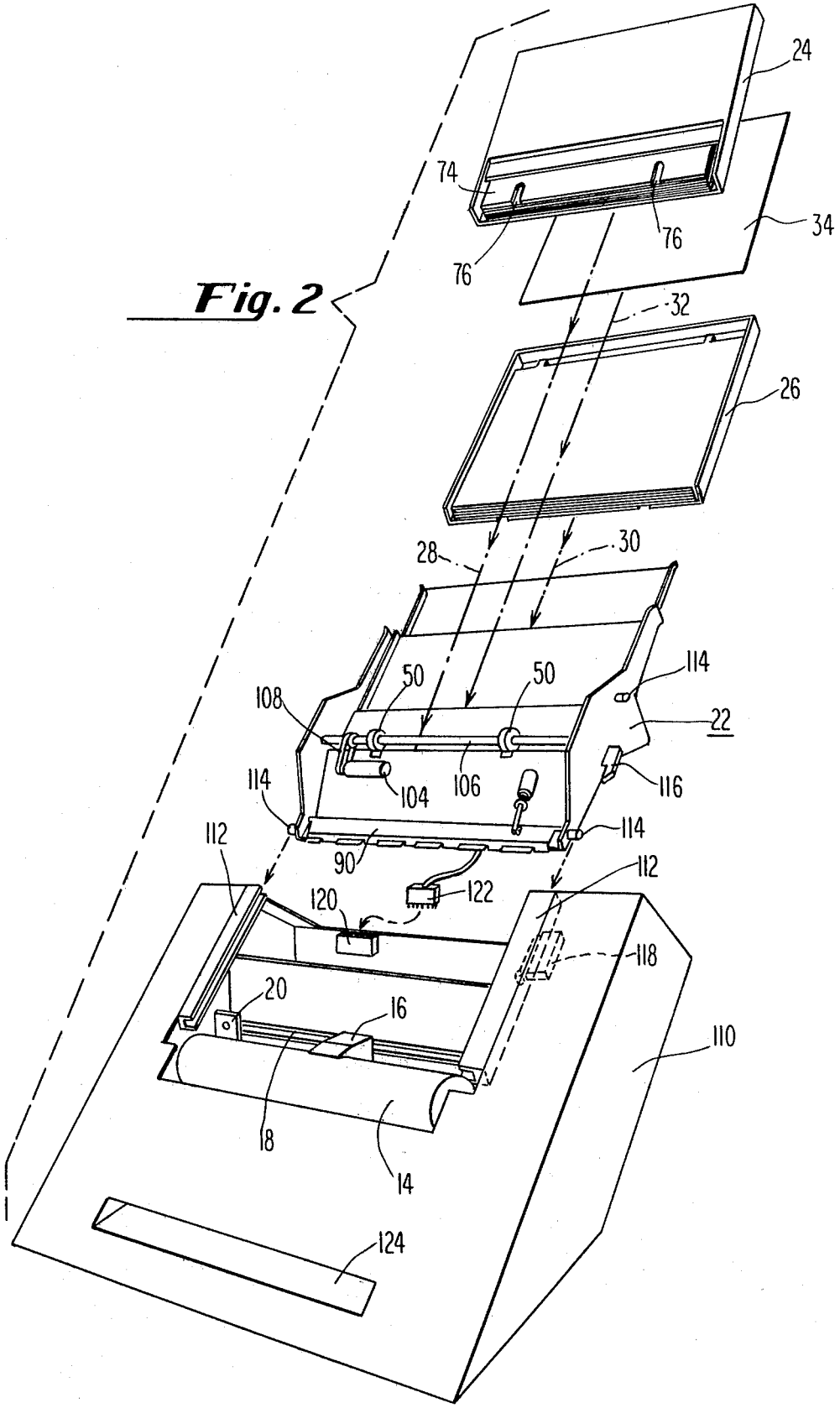
FIG. 2 is an exploded perspective view of the facsimile transceiver of FIG. 1.

Referring to FIGS. 1 and 2, a facsimile transceiver 10 comprises a housing 12 which carries a scanning means in the form of a rotatable scanning drum 14 adapted to rotate about its axis. The drum 14 is scanned by a head 16 shown in FIG. 2 which is adapted to move along a linear path parallel with the axis of the drum 14. Movement of the head is controlled by a band 18 which forms a closed loop around a pair of pulleys, one of which is mounted on a support member 20.

In accordance with this invention, the transceiver comprises a sheet feeding mechanism 22 which is capable of storing a plurality of document sheets in a stack as well as a plurality of copy medium sheets in a stack. More specifically, the sheet feeding mechanism 22 includes a removable document cassette 24 which is located on top of the sheet feeding mechanism 22 as shown in FIG. 1. The sheet feeding mechanism 22 also includes a removable copy medium cassette 26 located beneath the cassette 24. The document sheets from the cassette 24 pass along a document path 28 while the sheets of copy medium from the cassette 26 are passed along a copy medium path 30.

In accordance with another important aspect of the invention, an additional sheet feeding path is provided in the mechanism 22 for hand feeding sheets as depicted by an arrow 32 in FIG. 2. A sheet 34 has been illustrated in FIG. 2 and it will be appreciated that the sheet 34 may either comprise a document or copy medium.

In accordance with this invention, the various sheet feeding paths 28, 30 and 32 merge prior to reaching the drum 14 so as to allow the various sheets from the various storage areas and the various feeding paths to be applied to or loaded on the drum 14 from a common loading area or location. This common loading area and the merging of the various sheet feeding paths 28, 30 and 32 may perhaps best be appreciated by reference to FIGS. 3 and 4.

Figures 3, 4:
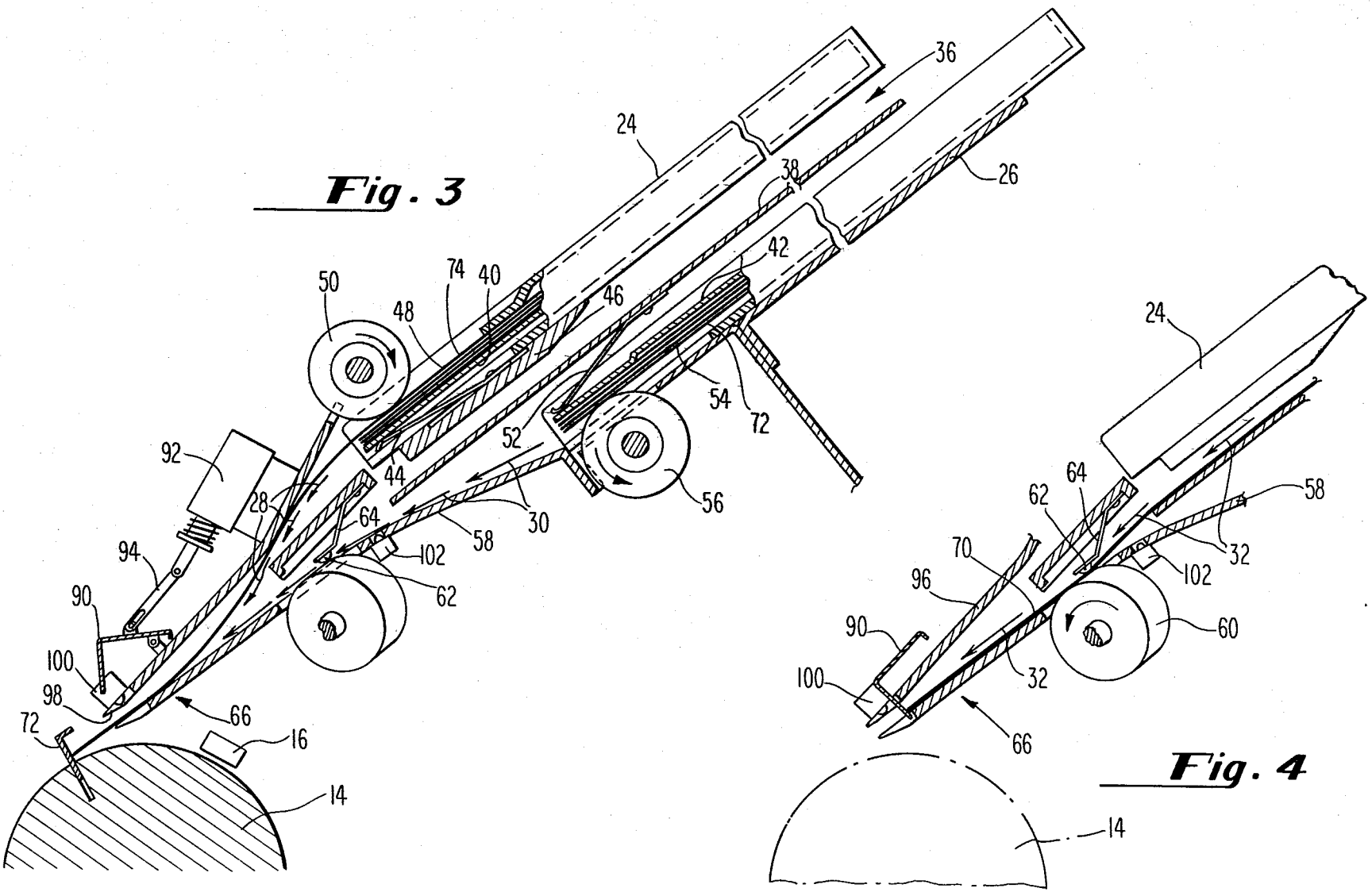
FIG. 3 is a sectional view of the transceiver of FIG. 1.
FIG. 4 is a partial sectional view similar to FIG. 3 showing a sheet being fed along a hand-fed path.

As shown in FIG. 3, the document cassette 24 is essentially parallel and positioned back-to-back with the copy medium cassette 26. However, the cassette 24 and the cassette 26 are sufficiently spaced so as to provide for the hand feeding of sheets through an opening 36. The spacing between the cassette 24 and the cassette 26 further provides sufficient room for a guide member 38 over which hand fed sheets may pass when moving toward the drum 14.

In accordance with one important aspect of the invention, the cassettes 24 and 26 are substantially parallel and the sheets within the cassettes or also parallel. In accordance with yet another important aspect of the invention, the cassette 46 is inverted with respect to the cassette 24. More specifically, the cassette 24 includes a backing plate 40 which is essentially located toward the bottom of the cassette 24 and supports sheets above. On the other hand, the cassette 26 includes a backing plate 42 which is essentially located above the sheets. The backing plate 40 is pushed upwardly by a leaf spring 44 mounted on a wall 46 of the cassette 24 so as to move the uppermost extremity 48 of the stack toward a scuff rolled 50 which pulls the document from the cassette 24.

Because of the inverted positon of the cassette 26, a leaf spring 52 mounted on the guide 38 forces the plate 42 downwardly such that the lowermost extremity 54 of the stack of copy medium is forced into engagement with a scuff roller 56. It will be appreciated that sheets of copy medium and documents are located between the uppermost extremity 48 and the lowermost extremity 54.

As shown in FIG. 3, the individual sheets of copy medium from the cassette 26 exits from the lowermost extremity 54 of the stack and, in response to the scuff roller 56, are moved along the feed path 30 as depicted by the arrows in FIG. 3. In the loading area 66, path 30 merges with the feed path 28 depicted by arrows which generally conform with the sheet 68 in FIG. 3.

As shown in FIG. 4, the hand fed sheet path 32 as depicted by the arrows in FIG. 4 also merges with the other feed paths in the area 66. As also shown in FIG. 4, a sheet 70 moving along the path 32 is advanced under the control of the canted roller 60.

From the foregoing, it should be appreciated that the sheet feeding mechanism 22 is relatively compact. Moreover, even though there are three different sheet feeding paths provided by the mechanism 22, it will be appreciated that the merging of the sheet feeding paths in the loading area facilitates loading of the drum 14 at a single location so as to simplify control and minimize the space requirements. As shown in FIG. 3, this loading is accomplished by inserting a sheet from any of the sheet feeding paths into an open clamp 72 which is subsequently closed just prior to rotation of the drum 14.

As previously discussed with reference to FIG. 4, the various sheets in the cassettes 24 and 26 are pulled from the cassettes 24 and 26 by means of scuff rollers 56. In order to assure that the scuff rollers 50 and 56 contact only a single sheet at a time, various sheets in the cassettes 24 and 26 are separated by plastic dividing sheet members 74. As shown in FIG. 2, the plastic dividing members 74 include elongated slots 76 in the cassette 24 where the slot 76 is adapted to receive a pair of scuff rollers 50 so as to permit contact between a sheet such as the sheet 68 which is located at the uppermost extremity 74 shown in FIG. 3.

As shown in FIGS. 3 and 4, a gate 90 is located adjacent the drum 14. In FIG. 3, the gate 90 is shown in the open position so as to permit document sheets to be fed from the cassette 24 and copy medium sheets to be fed from the cassette 26 without interference from the gate 90. In FIG. 4, the gate 90 is in the closed position so as to allow a sheet 70 hand fed along the path 32 to be fed to an advance position adjacent the drum 14 while the gate 90 is closed and thereafter feeding the sheet 70 to the drum 14 once the gate 90 is open. As shown in FIG. 3, the position of the gate 90 is controlled by a solenoid 92 which is coupled to the gate 90 through a linkage 94. The solenoid 92 and the gate 90 are mounted on a guide member 96 which includes an opening 98 in which a photodetector 100 is mounted for sheet control purposes. Another photodetector 102 which provides a sheet control function is mounted in the guide 58.

Referring to FIGS. 1 and 2, it can be appreciated that the roller 50 is present in a pair so as to engage the document in the cassette 24 at each of the pair of slots 76. It will also be appreciated that a pair of rollers 56 are provided although not shown in the drawings. As shown in FIG. 1, a motor 104 drives a shaft 106 which carries the rollers 50 by means of a belt 108. A similar drive is provided for the rollers 56.

As also shown in FIG. 2, the sheet feeding mechanism 22 as well as the cassettes 24 and 26 are readily separable from a base unit 110. The base unit 110 includes tracks 112 which are adapted to receive pins 114 on the sheet feeding mechanism 22. A cam 116 is adapted to cooperate with an electrical interlock mechanism 118 shown in phantom which is mounted on the base unit 110. The base unit 110 also includes an electrical receptacle 120 which meets with a plug 122 of the sheet feeding mechanism 22 for providing signals and power to the sheet feeding mechanism 22. A slot 124 at the bottom of the base unit 110 provides an outlet for the sheets of documents and copy medium once a transmission is complete.

Various aspects of the preferred embodiment of the invention as shown in FIG. 2 are disclosed in and form the subject matter of copending application Ser. No. 120,317 filed Feb. 11, 1980, Ser. No. 120,337 filed Feb. 11, 1980, Ser. No. 120,339 filed Feb. 11, 1980, Ser. No. 120,461 filed Feb. 11, 1980 and Ser. No. 120,462 filed Feb. 11, 1980. Accordingly, these patent applications are incorporated herein by reference as it set forth in full.

Figure 5:
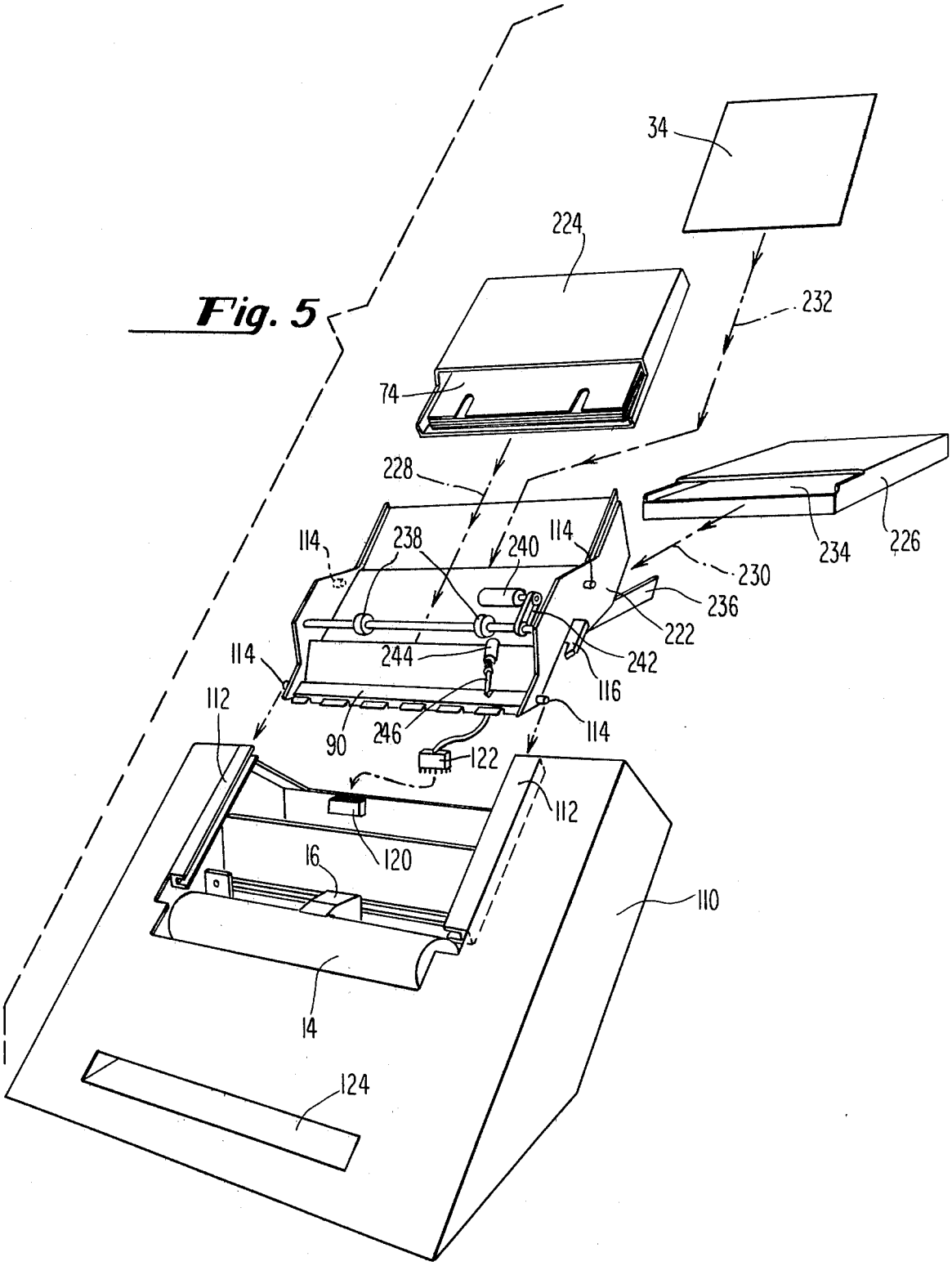
FIG. 5 is an exploded perspective view of an alternative embodiment of the invention.

Referring to FIG. 5, a base unit 110 identical to that shown in the embodiment of FIGS. 1–4 is disclosed. However, a sheet feeding mechanism 222 is disclosed which differs somewhat from the sheet feeding mechanism 22, but represents another embodiment of the invention wherein a plurality of sheet feeding paths 228, 230 and 232 are merged so as to permit feeding of the drum 14 from a common loading area. As shown in FIG. 5, the sheet feeding mechanism 222 differs in that a document cassette 224 is not inverted with respect to a copy medium cassette 226. Moreover, the cassette 226 does not utilize a plurality of plastic dividing members 74 but rather a stack of copy medium sheets 234 which are mounted in direct contact with one another. The cassette 26 is mounted in a tray 236, a portion of which is shown in FIG. 5. It will be appreciated from FIG. 5 that the hand fed sheet path 232 is located between the automated sheet feeding paths 228 and 230 and between the cassettes 224 and 226 themselves. Further details of the embodiment shown in FIG. 5 are disclosed in the aforesaid copending applications which are incorporated herein by reference in connection with the embodiment of FIG. 5. The function of the rollers 238, the motor 240 and the belt 242 and other details including the function of the solenoid 244 and its associated linkage 246 are also disclosed therein and incorporated herein by reference.

Although a two embodiments of the invention have been shown and described, it will be understood that other embodiments will occur to those of ordinary skill in the art which will fall within the true spirit and scope of the claims appended thereto.

What is claimed is:

1. Facsimile apparatus for transmitting and receiving signals representing dark/light variations on a document comprising:

scanning means;

document storage means for storing a plurality of document sheets to be scanned for dark/light variations for generating transmitted signals;

copy medium storage means for storing a plurality of copy medium sheets for recording dark/light variations represented by received signals;

a document feed path from said storage means to said scanning means;

a copy medium feed path from said copy medium storage means to said scanning means; and an additional sheet feed path;

said copy medium feed path, said document feed path, and said additional sheet feed path merging so as to form a single feed path at said scanning means.

2. The facsimile apparatus of claim 1 wherein said additional sheet feed path is located between said document storage means and said copy medium storage means prior to merging.

3. The facsimile apparatus of claim 1 wherein said document storage means includes a removable cassette for holding documents.

4. The facsimile apparatus of claim 1 wherein said copy medium storage means includes a removable cassette holding sheets of copy medium.

5. The facsimile apparatus of claim 1 wherein said document storage means includes:

document backing means for backing a stack of documents;

document feed means for advancing one sheet at a time from one extremity of said stack of documents; and said copy medium storage means includes copy medium backing means for packing a stack of copy medium; and copy medium feed means for advancing one sheet at a time from one extremity of said stack of copy medium;

said one extremity of said copy medium stack and said one extremity of said document stack having sheets of copy medium and documents therebetween.

6. The facsimile apparatus of claim 5 wherein said sheets of documents in said storage means are disposed substantially parallel with said sheets of copy medium in said copy medium storage means.

7. The facsimile apparatus of claim 6 wherein said document feed means comprises one roller engaging a document at said one extremity and said copy medium feed means comprises another roller engaging a copy medium at said other extremity, said one and said other roller being separated by sheets of documents and copy medium.

8. The facsimile apparatus of claim 1 wherein said scanning means comprises a drum having a clamp adapted to hold the copy medium and document in place.

9. The facsimile apparatus of claim 1 wherein said document storage means comprises a document cassette and said copy medium storage means comprises a copy medium cassette.

10. The facsimile apparatus of claim 9 wherein said document cassette and said copy medium cassette are back-to-back.

11. The facsimile apparatus of claim 10 wherein said document cassette and said copy medium cassette are mutually inverted.

12. A method of operating a facsimile apparatus comprising scanning means, the method including the following steps:

storing sheets in a document storage area;

feeding sheets from the document storage area toward a common loading area adjacent a scanning means prior to transmitting with the apparatus;

storing sheets in a copy medium storage area;

feeding sheets from the copy medium storage area to a common loading area adjacent the scanning means prior to receiving with the apparatus;

feeding sheets from a source different from said document storage area and copy medium storage area to the common loading area; and loading the scanning means from the common loading area.

13. The method of claim 12 wherein the path of sheets fed from the other source is between the paths feeding sheets from said document storage area and said copy medium storage area.

* * * * *